US005703919A

United States Patent [19]

Bailey et al.

[11] Patent Number: 5,703,919

[45] Date of Patent: Dec. 30, 1997

[54] FAIL-SAFE METHOD TO READ A TIMER WHICH IS BASED ON A PARTICULAR CLOCK WITH ANOTHER ASYNCHRONOUS CIRCIT

[75] Inventors: Joseph A. Bailey, Austin; Qadeer A. Qureshi, Round Rock, both of Tex.

[73] Assignee: Advanced Micro Devices, Inc., Sunnyvale, Calif.

[21] Appl. No.: 633,671

[22] Filed: Apr. 17, 1996

[51] Int. Cl.[6] ..... G07C 3/02

[52] U.S. Cl. ..... 377/16

[58] Field of Search ..... 377/16, 56

[56] References Cited

FOREIGN PATENT DOCUMENTS 0076654 7/1978 Japan ..... 377/16

OTHER PUBLICATIONS

IBM Tech Disc. Bul. vol. 26 No. 3A Aug. 1983 "Program Status Latch" Crosthwait et al.

*Primary Examiner*—Margaret Rose Wambach

*Attorney, Agent, or Firm*—Conley, Rose & Tayon PC; B. Noel Kivlin

[57] ABSTRACT

A method and apparatus for reading a timer with an asynchronous circuit. A computer system is provided having a system clock and an asynchronous timer clock. The computer system includes a counter clocking from the timer clock and a latch coupled to output of the counter. First logic, synchronized to the timer clock, is coupled to control the latch responsive to a control signal from the computer system. Second logic synchronized to the system clock and coupled to the first logic is configured to provide an indication to the computer system of when the system can read the latched data and be assured of its validity. The computer system will thereby be prevented from reading the timer before it has stabilized.

29 Claims, 3 Drawing Sheets

FAIL-SAFE METHOD TO READ A TIMER WHICH IS BASED ON A PARTICULAR CLOCK WITH ANOTHER ASYNCHRONOUS CIRCIT

BACKGROUND OF THE INVENTION

1. Field of the Invention

The present invention relates to timers in computer systems and, more particularly, to a method of reading a timer which is based upon a particular clock with another circuit which is based on a separate and asynchronous clock.

2. Description of the Related Art

Modern personal computer systems feature a variety of clock and timer circuits. A system clock typically synchronizes the bus, the microprocessor and related circuits. A second clock circuit typically controls a time-of-day clock that runs on separate battery power so that an accurate reading may be provided even for those periods during which the computer is turned off. A third circuit is the system timer, which synchronizes a timer counter or time tick counter. The time tick counter is used by the system to maintain time keeping functions within the computer system. The time tick counter generally generates an interrupt to the system at a rate of 18.2 per second. When the time tick counter interrupt is received by the microprocessor, a time tick service routine is executed, which for example, updates system clocks and can be used by programs that need to regularly execute a particular operation. Alternatively, the interrupt function may be disabled by the operating system, and the timer/counter used to time critical functions. For example, the operating system may program an initial value from which the timer will count down, during an ongoing operation. At the conclusion of the operation, the timer value will be read. The timer counter is typically clocked at 1.19 MHz, which was the clocking rate of the timer counter of the original IBM personal computer. The 1.19 MHz clock was divided down from a 14.31818 megahertz oscillator circuit, which was also used for the system clock.

Newer personal computers employ separate oscillator circuits for the system clock, the time tick counter, and the time-of-day clock. Thus, the time tick counter oscillator runs asynchronously with the system oscillator. Accordingly, it is possible for the system to attempt to read the time tick counter during the period of instability immediately following the time tick counter clock. This may result in an invalid read, which could cause failure of software that is dependent on valid timing.

In addition, with the advent of more modern operating systems, finer granularity is required for the timer counter. In fact, it is possible for the timer counter to clock at the same frequency as the system clock. As a consequence, it is increasingly possible for an invalid read to occur. There is therefore a need for a clock timer system in a computer system in which a read of the timer counter by the system clock will always result in valid data. More generally, there is a need for a method to ensure the validity of a read of a timer based on a first clock with another circuit which is based on a separate and asynchronous clock.

SUMMARY OF THE INVENTION

The problems outlined above are in large part solved by a timer read mechanism in a timer circuit that includes a counter and a latch coupled to the counter that is managed by timer control circuitry. In one embodiment, the timer control circuitry includes two separate state machines, one of which runs entirely from the timer clock and the other of which runs entirely from the system clock. The state machines communicate between themselves with asynchronous signals. The first state machine functions by sampling the read indication from the system with the timer clock. When a read condition is detected, it first latches valid data and then alerts the second state machine that it can provide an indication to the system that valid data is available to be read.

Since the state machines are asynchronous to one another, there is a possibility that an attempt by one to read an asynchronous signal from the other will occur on an asynchronous clock edge, a potential metastable condition resulting in an invalid read. The state machines, however, are configured such that whenever the next state transition involves the use of asynchronous inputs, the state machines will either stay in their current state or wait for the next clock if the data are received on a clock edge. While an asynchronous input may be read a clock cycle late, the read will always be valid. This, in turn, ensures that a system read of the time tick counter will itself always be valid. Thus, the timer read mechanism of the present invention advantageously accommodates the increased granularity required by modern operating systems and ensures that valid data will always be present before a system read is accomplished.

Broadly speaking, the present invention contemplates a computer system including a counter clocking from a timer clock and a latch coupled to output of the counter. First logic, synchronized to a timer clock, is coupled to control the latch responsive to a control signal from the computer system. Second logic, synchronized to the system clock and coupled to the first logic, is configured to provide an indication to the computer system of when the system can read the latched data and be assured of its validity.

The present invention further contemplates a method for providing a first clock to a counter and a first state machine, and providing a second clock asynchronous to the first clock to a second state machine coupled to the first state machine. The method further includes the steps of latching data from outputs of the counter responsive to a signal from the first state machine, providing a signal to the system from the second state machine indicative of the presence of valid data, and reading the data from the latch.

BRIEF DESCRIPTION OF THE DRAWINGS

A better understanding of the present invention can be obtained when the following detailed description of the preferred embodiment is considered in conjunction with the following drawings, in which.

Figure 1:
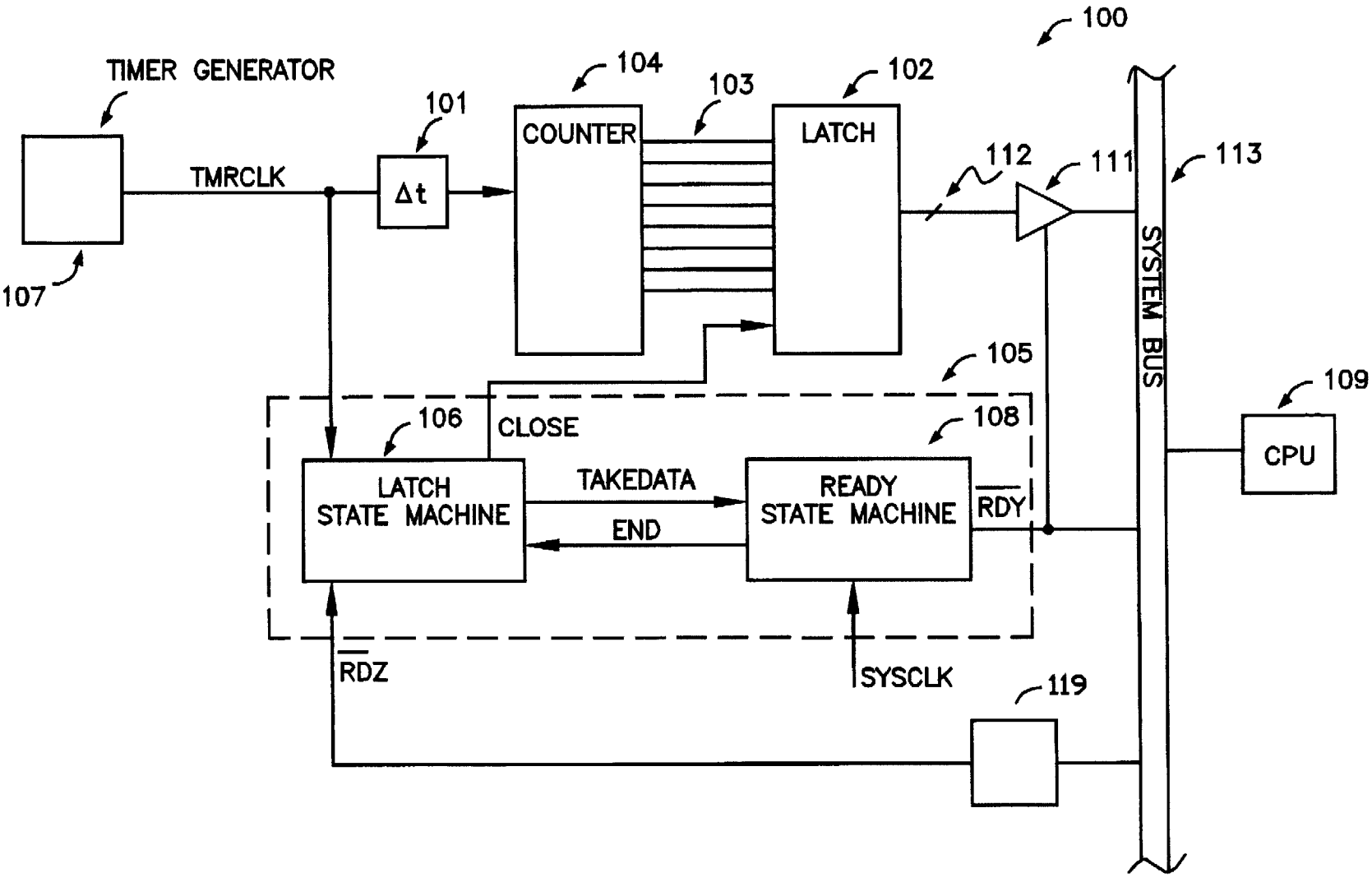
FIG. 1 is a block diagram of a timer circuit according to the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE INVENTION

Referring now to the drawings, and with particular attention to FIG. 1, there is shown a block diagram of an exemplary clock circuit 100 in a computer system (not shown), including a counter 104 coupled to a latch 102. The output 112 of latch 102 are coupled to a system bus 113, to which a processor 109 is coupled. The clock circuit further includes counter control circuitry 105. In the embodiment shown and discussed, a pair of state machines or sequential logic networks is employed. However, the use of equivalent logic or circuits is contemplated. A ready state machine 108 is coupled to a latch state machine 106. Latch state machine 106, in turn, is coupled to latch 102. Latch state machine 106 and counter 104 are synchronized to the timer clock, TMRCLK. A delay element 101, may be coupled between timer generator 107 and counter 104. TMRCLK is generated by timer generator 107. Ready state machine 108 is synchronized to the system clock, SYSCLK. Latch state machine 106 outputs the CLOSE and TAKEDATA signals and receives the read signal RDZ from the computer system. Ready state machine 108 generates an end signal END to the latch state machine 106 and outputs the ready signal $\overline{\text{RDY}}$ to the system.

A decoder 119 is coupled to system bus 113 and is configured to assert a read signal RDZ at latch state machine 106. When the timer is to be read, the computer system (synchronized to the system clock, SYSCLK) sends a predetermined bus cycle which is detected by decoder 119. Decoder 119, in turn, asserts the read signal RDZ. Latch state machine 106, which is synchronized to the timer clock TMRCLK, will assert CLOSE. This causes the latch 102 to latch the current data from the counter. Latch state machine 106 will then provide the TAKEDATA signal to the ready state machine 108, which is synchronized to SYSCLK. Asserting TAKEDATA informs ready state machine 108 that valid data is available. Ready state machine 108 asserts $\overline{\text{RDY}}$, synchronous to the system clock. The processor 109 reads the timer data from the latch responsive to the $\overline{\text{RDY}}$ signal. Ready state machine 108 then provides the END signal to the latch state machine 106. Responsive to the END signal, latch state machine 106 deasserts CLOSE. Delay element 101 is provided because it may be necessary to delay the timer clock TMRCLK for the period required for CLOSE to propagate through circuitry 105 responsive to RDZ from the decoder. Thus, the counter will be prevented from overcounting.

Figure 2A:
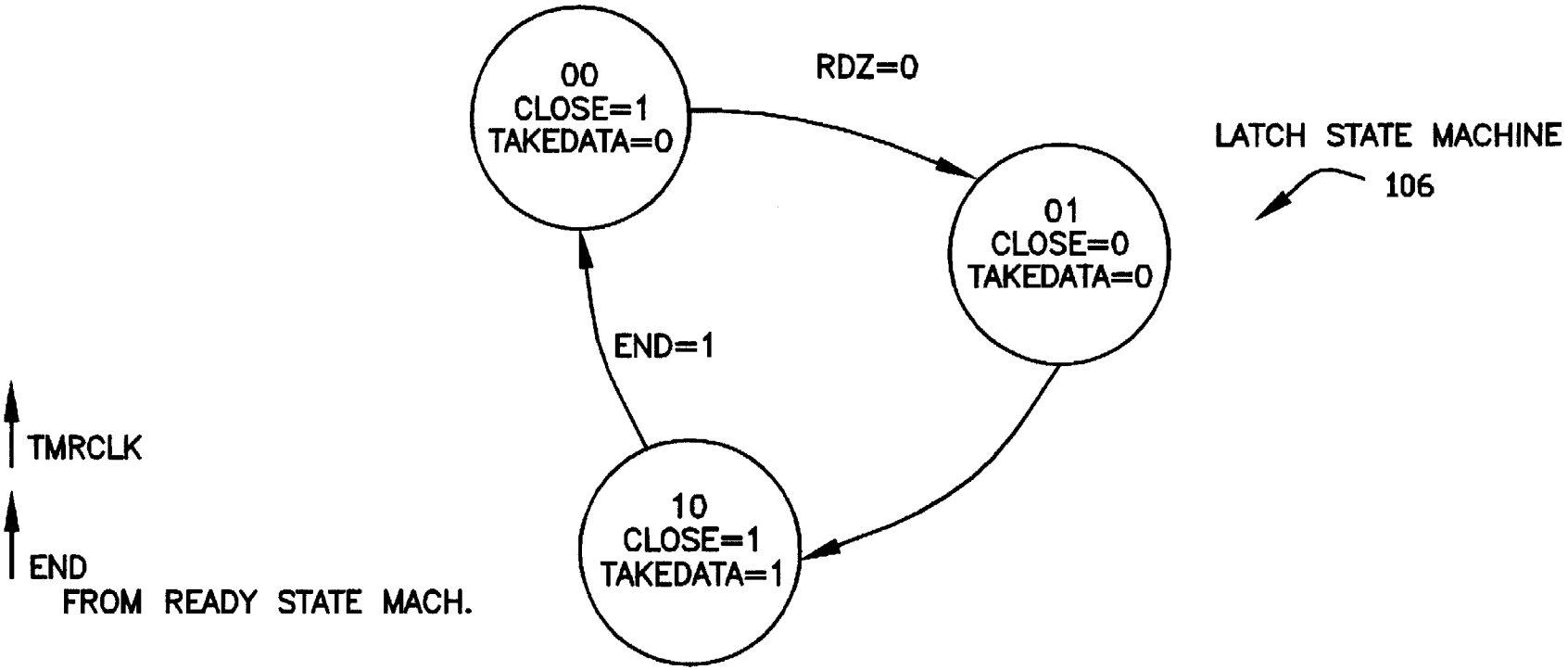
FIGS. 2*a* and 2*b* are state diagrams of latch state machine and a ready state machine according to the present invention.

Operation of the system is more clearly illustrated with reference to FIGS. 2*a* and 2*b*, which represent state diagrams of the latch state machine 106 and the ready state machine 108, respectively. Latch state machine 106 runs entirely from the timer clock TMRCLK and receives the END signal from the ready state machine 108, which runs entirely from the system clock SYSCLK. Thus, END is asynchronous with the latch state machine 106. Latch state machine 106 provides CLOSE to latch 102 and TAKEDATA to ready state machine 108 as discussed below. In state 0,0 in the latch state machine 106, CLOSE is high and TAKEDATA is low. Upon reception of the read signal RDZ from the computer system or processor 109, the latch state machine 106 will transition to state 0,1. At this point, CLOSE goes active low, and TAKEDATA remains the same. Physically, latch 102 has "captured" the output of counter 104. It will be recalled that the read signal RDZ is asynchronous to the timer clock. Thus, it is possible for the read signal RDZ to be received on a transition of the timer clock. In this potentially metastable condition, the latch state machine 106 remains stable because it is configured such that between state 0,0 and state 0,1, if the read signal RDZ is missed on a given TMRCLK, state machine 106 will remain in its current state 0,0. The read signal RDZ will be caught on a subsequent clock and the state machine 106 will transition from state 0,0 to state 0,1 on that subsequent clock. Thus reading RDZ on an edge will not result in an invalid read. Thus, while reading the counter value may occur a clock pulse late, it will not be an unstable value. On the next clock, latch state machine 106 transitions from state 0,1 to state 1,0. At this point, the CLOSE signal goes high, thereby locking the latch 102, and TAKEDATA is sent high. As long as CLOSE is high, the latch 102 is not allowed to open. Sending TAKEDATA high will inform the ready state machine 108 that there is valid data on signal lines 112, as will be discussed in more detail below. Once the data are ready to be read, the ready state machine 108 will generate the end signal END, and latch state machine 106 will transition from state 1,0 to state 0,0, deasserting TAKEDATA. Again, however, it is to be noted that END is synchronous with the system clock and asynchronous with the timer clock. Thus, there is a potential for an invalid read. Again, however, the transition from 1,0 to 0,0 is such as if END is received on an edge, no invalid read will occur. The END signal will be read on a particular timer clock signal or the subsequent timer clock signal. The latch 102 will not be opened, allowing the data to change, until END is signaled by the ready state machine 108.

Figure 2B:
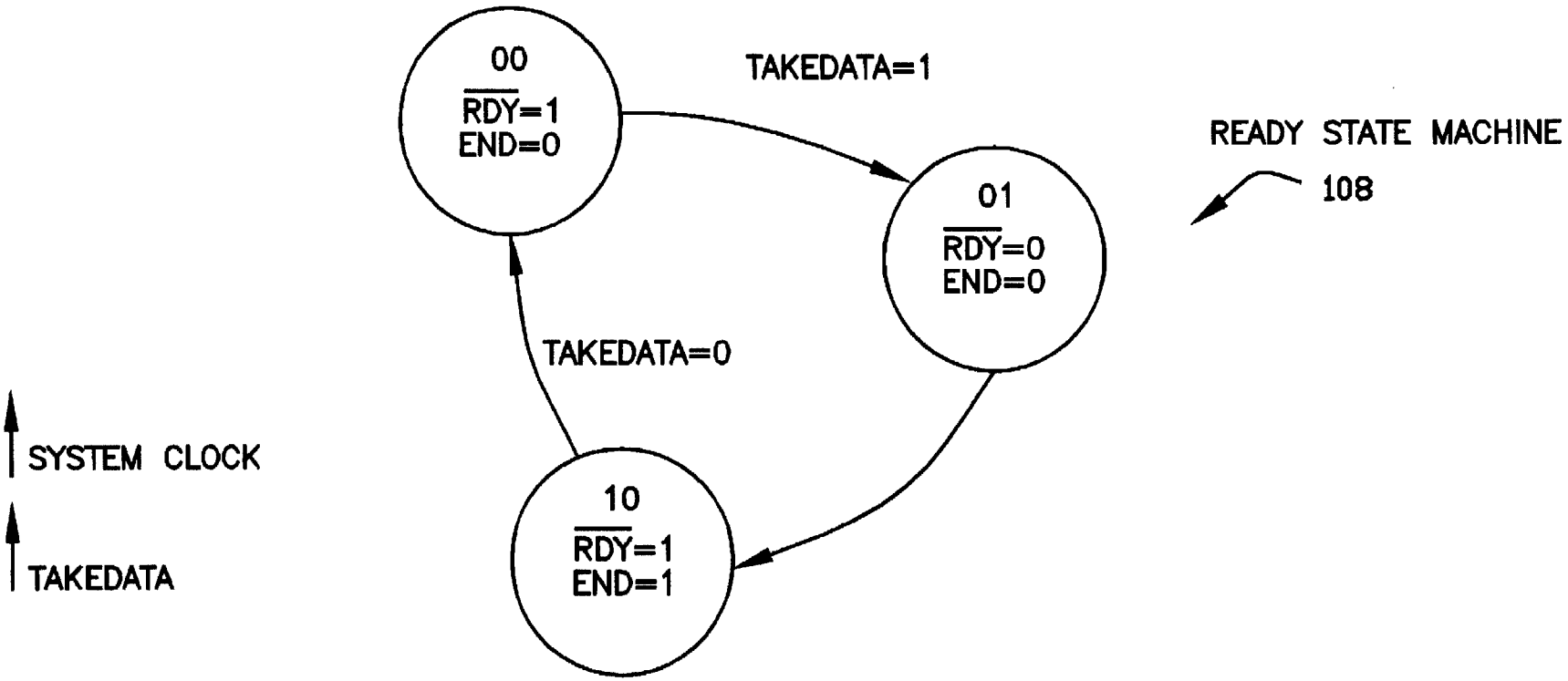

Turning now to FIG. 2*b*, there is shown a state diagram of ready state machine 108. More particularly, in state 0,0 the ready signal $\overline{\text{RDY}}$ is deasserted high and the end signal END is low. Upon receipt of TAKEDATA, the ready state machine 108 will transition from state 0,0 to state 0,1 sending the ready signal $\overline{\text{RDY}}$ active low. TAKEDATA is asynchronous to the system clock and hence is asynchronous to the ready state machine. Consequently, the potential for an invalid read on a clock edge exists. However, once again, the transition from 0,0 to 0,1 is configured such that the ready state machine 108 will either safely stay in the current state 0,0 or safely transition to the new state 0,1 if the read occurs on a clock edge. On the clock after entering state 0,1, ready state machine 108 will clock to state 1,0, deactivating the ready signal $\overline{\text{RDY}}$ and activating the end signal END. The end signal END is received by the latch state machine 106 as discussed above. Responsive to the reception of the end signal END from the ready state machine 108, the latch state machine 106 will send TAKEDATA low. This will cause the transition from state 1,0 to state 0,0 in the ready state machine 108. Again, the state machine is configured such that no invalid read on a clock edge will occur. The state machine will either stay in state 1,0 or transition to 0,0, deasserting END.

Although the system and method of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

We claim:

1. A timer counter circuit for a computer system, comprising:

a counter clocked by a timer clock;

a latch coupled to receive an output from said counter; and counter control circuitry, including;

a first circuit coupled to control said latch, responsive to a first control signal from said computer system, wherein said first circuit is coupled to be clocked from said timer clock;

a second circuit coupled to said first circuit, wherein said second circuit is coupled to be clocked from a system clock asynchronous to said timer clock; and wherein said counter control circuitry is configured to provide an indication to said computer system that said computer system may read valid data from said latch.

2. The timer counter circuit of claim 1, wherein said first circuit comprises a first state machine.

3. The timer counter circuit of claim 1, wherein said second circuit comprises a second state machine.

4. The timer counter circuit of claim 1, wherein said second circuit is configured to provide said indication to said computer system that said computer system may read valid data from said latch.

5. The timer counter circuit of claim 1, wherein said first control signal is a signal for requesting a read of said output.

6. The timer counter circuit of claim 1, wherein said first circuit is configured to provide a second control signal to said latch to cause said latch to latch said output from said counter.

7. The timer counter circuit of claim 6, wherein said second control signal is synchronous to said timer clock.

8. The timer counter circuit of claim 1, wherein said second circuit is configured to receive a third control signal from said first circuit indicating that said output has been latched.

9. The timer control circuit of claim 8, wherein said second circuit is configured to provide a ready signal to said computer system responsive to said third control signal and synchronous to said system clock.

10. A method of reading a timer in a computer system, comprising:

providing a first clock to a counter and first logic;

providing a second clock asynchronous to said first clock to second logic coupled to said first logic;

latching data from outputs of said counter responsive to a first signal from said first logic;

providing a second signal from said second logic indicative of the presence of valid latched counter data in said latch; and reading said latch synchronous to said second clock.

11. The method of claim 10, including generating said first signal responsive to an indication from said computer system that said timer is to be read.

12. The method of claim 10, wherein said first logic includes a first state machine.

13. The method of claim 10, wherein said second logic includes a second state machine.

14. A timer in an electronic device comprising:

a processor configured to clock from a first clock signal;

a counter configured to clock from second clock signal asynchronous to said first clock signal;

a latch coupled to receive an output from said counter;

counter control circuitry configured to provide an indication to said processor when valid data are ready to be read from said latch, including;

first logic coupled to clock from said first clock signal; and second logic coupled to said first logic and configured to clock from said second clock signal.

15. The timer of claim 14, wherein said first logic is configured to provide said indication to said processor when valid data are ready to be read from said latch.

16. The timer of claim 14, wherein said first logic includes a first state machine.

17. The timer of claim 14, wherein said second logic includes a second state machine.

18. The timer counter circuit of claim 14, wherein said second logic is configured to provide said indication to said computer system that said computer system may read valid data from said latch.

19. The timer counter circuit of claim 14, wherein said first control signal is a signal for requesting a read of said output.

20. The timer counter circuit of claim 14, wherein said first logic is configured to provide a second control signal to said latch to cause said latch to latch said output from said counter.

21. The timer counter circuit of claim 20, wherein said second control signal is synchronous to said timer clock.

22. The timer counter circuit of claim 14, wherein said second circuit is configured to receive a third control signal from said first circuit indicating that said output has been latched.

23. The timer control circuit of claim 22, wherein said second circuit is configured to provide a ready signal to said computer system responsive to said third control signal and synchronous to said system clock.

24. A timer circuit, comprising:

a counter synchronized to a first clock signal;

a latch coupled to said counter and configured to provide an output to a system synchronized to a second clock;

a first state machine coupled to said latch, synchronized to said first clock signal and coupled to receive a first control signal synchronized to said second clock signal;

a second state machine synchronized to said second clock and coupled to said first state machine, said second state machine being configured to provide a second control signal to said system indicative of when valid data may be read from said latch, and wherein said latch latches said valid data through said latch responsive to a third control signal received from said first state machine.

25. A timer in a computer system, comprising:

a counter synchronized to a first clock;

a latch coupled to said counter having outputs readable by said computer system, said computer system being synchronized to a second clock asynchronous to said first clock; and means for ensuring that said computer system always reads valid data from said latch.

26. The timer of claim 25, wherein said ensuring means includes a first circuit coupled to said latch and responsive to a control signal from said computer system.

27. The timer of claim 26, wherein said ensuring means includes a second circuit coupled to said first circuit and configured to provide an indication to said computer system of when valid data may be read from said latch.

28. The timer of claim 27, wherein said first circuit includes a first state machine.

29. The timer of claim 28, wherein said second circuit includes a second state machine.

* * * * *